US005548967A

United States Patent [19]

Ghiraldi

[11] Patent Number: 5,548,967

[45] Date of Patent: Aug. 27, 1996

[54] METHOD AND APPARATUS FOR ABSORBING HEAT AND PRESERVING FRESH PRODUCTS AT A PREDETERMINED TEMPERATURE ENSURING OPTIMAL CONDITIONS OF SAME

[75] Inventor: Alberto Ghiraldi, Reno di Leggiuno, Italy

[73] Assignee: N.R. Development Limited, Dublin, Ireland

[21] Appl. No.: 377,195

[22] Filed: Jan. 24, 1995

[51] Int. Cl.[6] ..... F25D 17/02

[52] U.S. Cl. ..... 62/99; 62/434

[58] Field of Search ..... 62/434, 78, 99

[56] References Cited

U.S. PATENT DOCUMENTS

| | | | |
|---|---|---|---|
| 3,280,586 | 10/1966 | Funokushi | 62/371 |
| 4,452,051 | 6/1984 | Berger et al. | 62/430 |
| 5,172,567 | 12/1992 | Sadhir | 62/434 |
| 5,272,887 | 12/1993 | Zendzian, Sr. | 62/434 |

FOREIGN PATENT DOCUMENTS 0399449 5/1989 European Pat. Off. .

1229358 5/1989 Italy .

*Primary Examiner*—Ronald C. Capossela

*Attorney, Agent, or Firm*—Shlesinger Fitzsimmons Shlesinger

[57] ABSTRACT

A method and an apparatus for absorbing heat and preserving fresh products under optimal conditions is described. The products are introduced into a chamber of which at least 70%–80% of the wall surfaces consists of box-shaped interspace panels filled with a thermal capacitance fluid having a freezing temperature with a ΔT included between −1° and −4° C. compared to the refrigeration temperature. Disposed within the panel interspace are circulating circuits containing a brine fluid fed at a temperature having a ΔT included between −5° and −30° C. compared to the refrigeration temperature. The brine circuit is disposed within the panel interspace for distributing the exchange between the brine fluid and the thermal capacitance fluid so as to keep the ΔT between the maximum and minimum temperature points of the wall under 5° C., preferably not higher than 2° C. and particularly not higher than 1° C.

14 Claims, 5 Drawing Sheets

METHOD AND APPARATUS FOR ABSORBING HEAT AND PRESERVING FRESH PRODUCTS AT A PREDETERMINED TEMPERATURE ENSURING OPTIMAL CONDITIONS OF SAME

BACKGROUND OF THE INVENTION

The present invention relates to an innovatory method and an apparatus for cooling and/or preserving perishable products under optimal conditions, and it refers in particular to fresh alimentary products or other materials different from the alimentary ones.

Low-temperature preservation methods are known in the art which consist in placing the products to be preserved into cooling containers, such as for example containers for goods transportation internally provided with evaporation panels of a refrigerating circuit for keeping low temperatures inside them. Due to the existence of discrete heat exchange surfaces, temperature in these containers is not at all uniform, as there are areas with a greater or lesser degree of cold depending on the distance from the evaporator and this also in the case in which air circulating systems are used within the container. In addition to local temperature variations it is also to be taken into account the fact that, due to their own nature, the above refrigerating systems have a non-eliminable hysteresis in controlling temperature inside the container, so that said temperature can oscillate within a rather wide range. The temperature constancy is also impaired by a virtually inexistent thermal storage offered by the cooling system. Short interruptions in the cooling system operation in fact give rise to rapid temperature increases in the container. In addition, the typical operation of these systems is of the on/off type, which results in continuous temperature oscillations.

Another undesired effect caused by the discrete heat exchange surfaces resides in that the heat exchanger has a remarkably lower temperature than the air temperature in the chamber, so that the humidity substracted from the products to be preserved condenses on the heat exchangers. For these reasons containers of the above type are well adapted to the trasportation of frozen goods, because for preserving them it is only important that a predetermined maximum temperature be not exceeded, the oscillations in the preservation temperature under this maximum value being on the contrary well tolerated and a reduction in the relative humidity in the container being quite irrelevant.

On the contrary, in order to ensure an optimal preservation for fresh products such as fruit, vegetables, cut flowers, seafood, meat, etc, they must be kept to a temperature as close as possible to the maximum freezing point, with deviations on the order of $\leqq 1°$ C. In order to achieve such results it is necessary to offer a very precise temperature regulation and a virtual elimination of the external sinusoid or at all events attenuation values better than 1:60. Any temperature variation different from such a minimum value therefore brings about worsening in preservation. In particular, temperature oscillations typical of conventional systems represent thermal cycles involving an accelerated aging of the products. In addition, any humidity subtractions from said products are very detrimental because they cause a quick withering and the forced ventilation systems of conventional containers (used for trying to keep the temperature gradients between the different points of the container sufficiently small) contribute to a rapid deterioration of the products, involving loss in weight and withering. This process is accelerated by the combined effect of the humidity subtractions due to the low (typically lower than 70%) relative humidity levels of the containers and a high (typically higher than 5 m/s) ventilation rate. In the Italian patent No. 1229358 filed on May 23, 1989 a refrigerated transportation means is disclosed which comprises a refrigeration circuit cooling an aqueous solution located on board of the transportation means and constituting a thermal accumulator. After the solution is completely frozen, the primary refrigeration circuit is disactivated and a secondary exchange device causes a brine fluid to circulate for a heat exchange between the thermal accumulator and exchange elements disposed within the container. By the above system an increase in the temperature steadiness on the exchange surfaces is achieved as well as the possibility of reducing the energy consumption over long periods of time, as the only necessary energy required is the small amount for operating the brine fluid circulation devices. However, the temperature steadiness by itself does not give satisfactory results in terms of best preservation of fresh products as the refrigerant system is at all events based on discrete exchange elements through which a brine fluid circulates.

U.S. Pat. No. 3,280,586 describes a portable cooler which has walls containing heat exchange elements spaced apart the same distance from each other. Each exchange element comprises a square box-shaped casing forming a cavity filled with thermal capacitance fluid into which an exchanger, in which a brine fluid circulates, is dipped. The brine fluid is circulated so that the heat exchange within the whole portable cooler takes place in a combined manner through the frozen thermal capacitance fluid and the thermal bridging existing between the brine fluid circuit and the wall. Thus the thermal accumulators sufficient to ensure a good stability in temperature on the exchange surfaces in contact with the portable cooler chamber are provided. U.S. Pat. No. 3,280,586 however does not take care of achieving a particularly low $\Delta T$ between the exchange surfaces and the air and, in addition, does not take care of having an as much as possible uniform temperature within the chamber. In fact, the exchange surfaces are still discrete surfaces and do not involve the whole of the portable cooler's inner surface. In addition, the different exchange elements have the brine circuit disposed in series and there are high temperature differences between the fluid inlet and outlet therein. As a result there is, among other things, the impossibility of embodying containers having relatively big sizes and wide exchange surfaces, because of the excessive pressure drops which would occur in the fluid circulation.

The foregoing, together with the important thermal bridges existing between the brine fluid and the inside of the portable cooler, which are not shielded from the thermal capacitance fluid in the cavities, creates localized areas of inacceptably low temperature. In addition, the brine fluid circuits dipped in the thermal capacitance fluid to be frozen have fins disposed in radial planes normal to the pipe axis, which prevents a uniform freezing of the thermal capacitance fluid from the brine fluid circuits to the wall not allowing a proper heat transfer between the thermal capacitance fluid and the portable cooler chamber. Thus there are areas in which ice bridges between the brine fluid circuits and exchange wall are formed, whereas other areas are still in a liquid phase. As a result, the areas on the inner walls of the container have different temperatures thereby giving rise to both temperature unevennesses in the chamber and formation of condensate, which will bring about subtraction of humidity from the inner environment.

As a matter of fact, the portable cooler described in the U.S. patent (at all events inadapted to undergo thermal expansions) is only useful if a limited thermal storage is to be supplied and is unable to control the temperature of the heat exchange walls. Therefore, it enables perishable goods to be quite well preserved only when it runs in a steady state, that is when the liquid in the cavities is completely frozen and the temperature of the goods is at the desired value within the chamber. On the contrary, it is completely inappropriate for cooling of the goods, that is when it is necessary to bring them to the preservation temperature starting from the external temperature for example, and to keep a constant temperature at all points in the chamber. Neither does it enable the partly melted liquid to be uniformly brought back to the solid phase so as to keep constant and uniform temperatures on the heat exchange surfaces with the portable cooler chamber. Therefore the system is useful as far as small portable coolers having reduced autonomy are concerned, for example those designed to operate over short distances for substantially local transportation and distribution of products, as recharging from the outside or installation of incorporated recharging systems is impossible (with the products inside).

Note should be also taken of that vegetable products have a high heat production (in the range of one hundred of watt per ton of products, for example). Therefore, known portable coolers that cannot be recharged in use and have restrained thermal capacitance and reduced air exchange surfaces can keep the inner temperature constant only over very short periods of time.

The general object of the present invention is to eliminate the above drawbacks by providing a method and apparatus for cooling fresh products and preserving them under optimal environmental conditions through the control of the wall temperature and consequently the inner air temperature.

SUMMARY OF THE INVENTION

In view of the above object a method for absorbing heat and keeping products under optimal preservation conditions at a predetermined temperature is envisaged, according to which the products are introduced into a chamber of which at least 70% and preferably more than 80% of the wall surfaces consists of box-shaped interspace panels filled with a thermal capacitance fluid having a freezing temperature with a ΔT included between −1° and −4° C. compared to the predetermined temperature, and brine fluid circuits containing a refrigerant or brine fluid fed at a temperature having a ΔT included between −5° and −30° C. compared to the refrigeration temperature are disposed within said panel interspace, said circuits being provided within the panel interspace in order to distribute the exchange between the brine fluid and the thermal capacitance fluid in the interspaces so that the ΔT between the maximum and minimum temperature points of the wall be kept under 5° C., preferably not higher than 2° C. and particularly not higher than 1° C.

According to the above method, an apparatus for absorbing heat and keeping products under optimal preservation conditions at a predetermined temperature is envisaged, which comprises a chamber into which the products are introduced, at least 70% and preferably more than 80% of the wall surfaces of the chamber consisting of box-shaped interspace panels filled with a thermal capacitance fluid having a freezing temperature with a ΔT included between −1° and −4° C. compared to the predetermined temperature, and brine fluid circuits containing a refrigerant fed at a temperature having a ΔT included between −5° and −30° C. compared to the refrigeration temperature being disposed within said panel interspace, said circuits being provided within the panel interspace in order to distribute the exchange between the brine fluid and the thermal capacitance fluid in the interspaces so that the ΔT between the maximum and minimum temperature points of the wall be kept under 5° C., preferably not higher than 2° C. and particularly not higher than 1° C.

BRIEF DESCRIPTION OF THE DRAWINGS

For better explaining the innovatory principles of the present invention and the advantages it offers over the known art, a possible embodiment of the invention putting said innovatory principles into practice will be given hereinafter by way of non-limiting example with the aid of the accompanying drawings, in which.

DETAILED DESCRIPTION OF THE INVENTION

Figure 1:
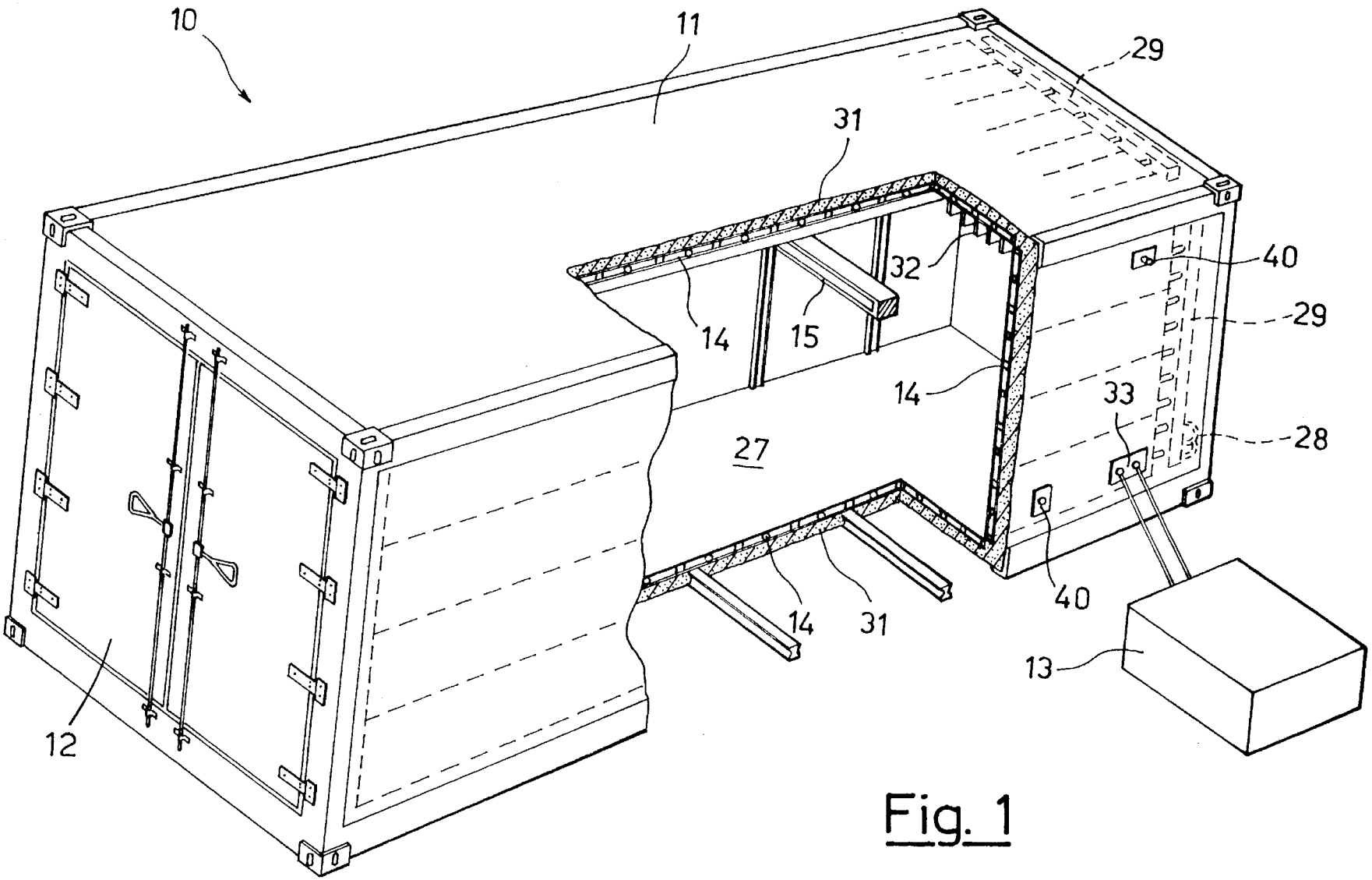
FIG. 1 is a perspective diagrammatic partly sectional view of a container or preservation apparatus according to the invention.

Referring to the drawings, diagrammatically shown in FIG. 1 is an apparatus in accordance with the invention, generally identified by the reference number 10 and comprising a container 11 having outwardly insulated (by known insulating material 31) walls and access doors 12 to encompass a preservation and cooling chamber 27. The apparatus can be made for example as a container of standard sizes (10, 20, 30, 40 feet long, for example) to be carried by traditional means of transport.

Figure 2:
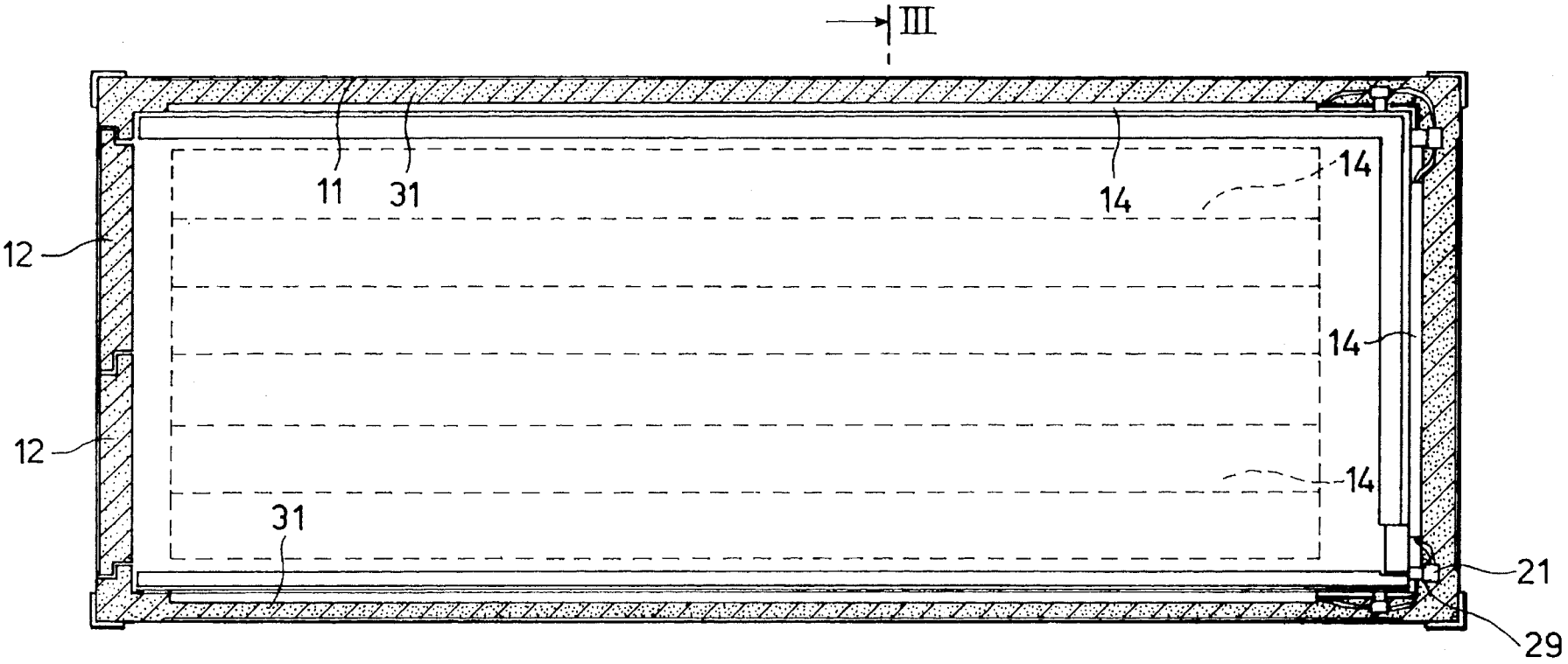
FIG. 2 is a diagrammatic plan sectional view of the apparatus of FIG. 1.
Figure 3:
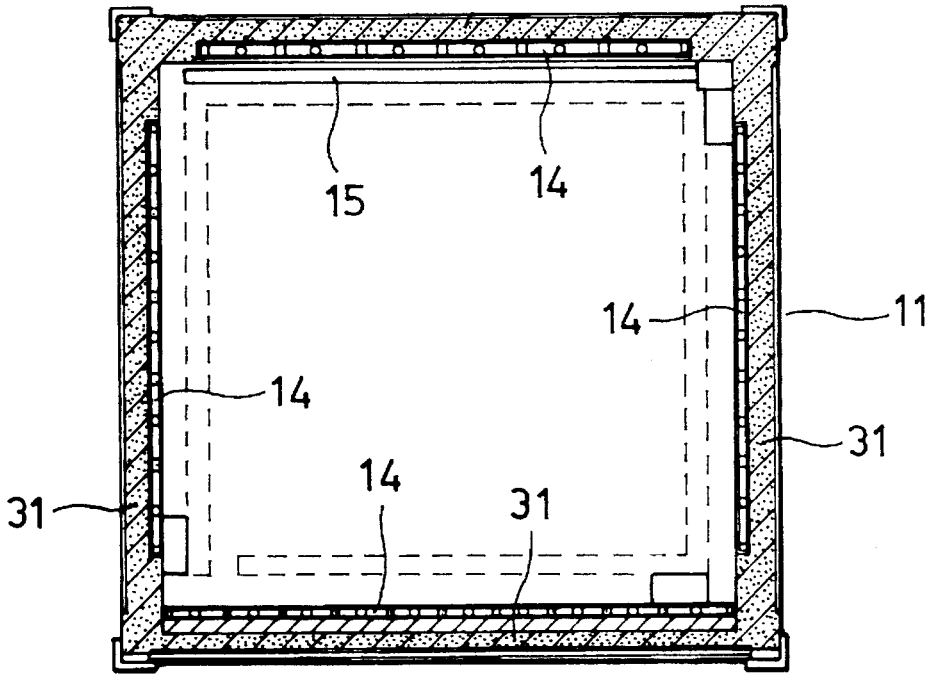
FIG. 3 is a diagrammatic cross-sectional view taken along line III—III in FIG. 2.

As clearly shown in FIGS. 2 and 3 as well, rectangular panels 14 for carrying out a heat exchange with the container chamber are fitted in registering recesses in the container walls and they substantially occupy the whole extension of the inner surface of the container, by the term "substantially occupy the whole extension" meaning at least 70–80% of the inner surface. Preferably, at least 80% of the wall surface may be occupied by said panels.

According to the innovatory preservation method consisting in taking up heat (or carrying out a cooling operation), it has been found that best results are achieved by keeping the ΔT between the maximum and minimum temperature points of the inner wall in the chamber under 5° C., and preferably not higher than 2° C., particularly not higher than 1° C. Such a result cannot be reached with the preservation and cooling methods of the known art. The exchange panels are connected to one another, as better clarified in the following, so as to constitute a flowing circuit for a brine fluid from a refrigerating device 13 of known design. The brine fluid is supplied to the circuits or pipes with a ΔT included between −5° C. and −30° C. compared to the intended cooling temperature in the chamber 27.

Figure 4:
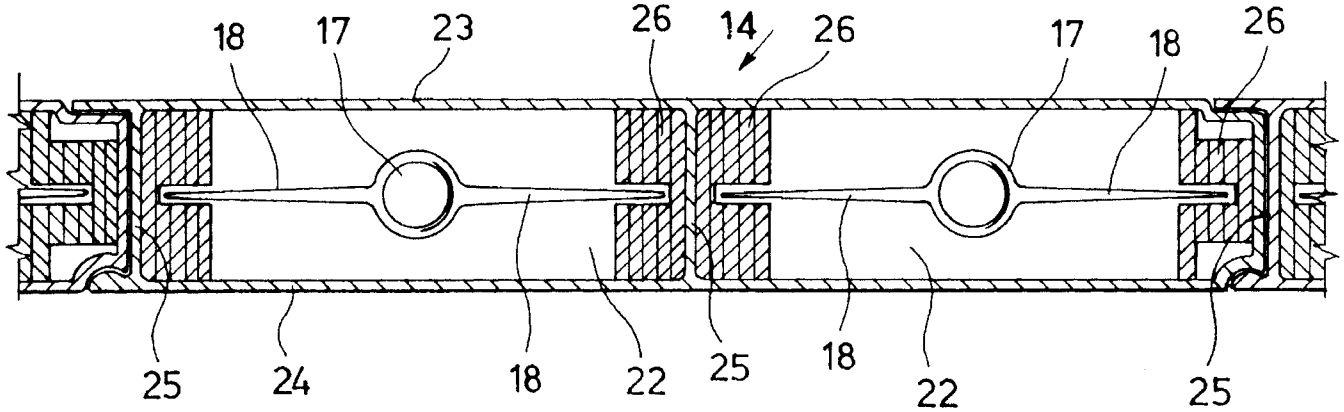
FIG. 4 is a diagrammatic sectional view of heat exchange elements being part of the apparatus of FIG. 1.

As shown in FIG. 4, each panel 14 is comprised of two facing walls 23, 24 interconnected by transverse partitions 25 to form a box-shaped structure identifying a plurality of interspaces or cavities 22 generally extending lengthwise of the walls. The box-shaped structure is made of a material having a suitable thermal conductivity which, for reaching a good ratio between weight, mechanical features and thermal features, may be aluminium or composite materials, for example.

Each interspace 22 is filled with a freezable liquid, selected to have a freezing temperature having a value approaching the temperature that one wishes to maintain in the chamber 27. In particular, the fluid has a freezing temperature in the range of −1° to −4° C. compared to the desired cooling temperature.

Filling with liquid in the interspaces must leave a void space therein corresponding to about 10% of the volume, and air is removed therefrom so as to enable absorption of the expansions undergone by the liquid on freezing without any stress for the structure.

Figure 6:
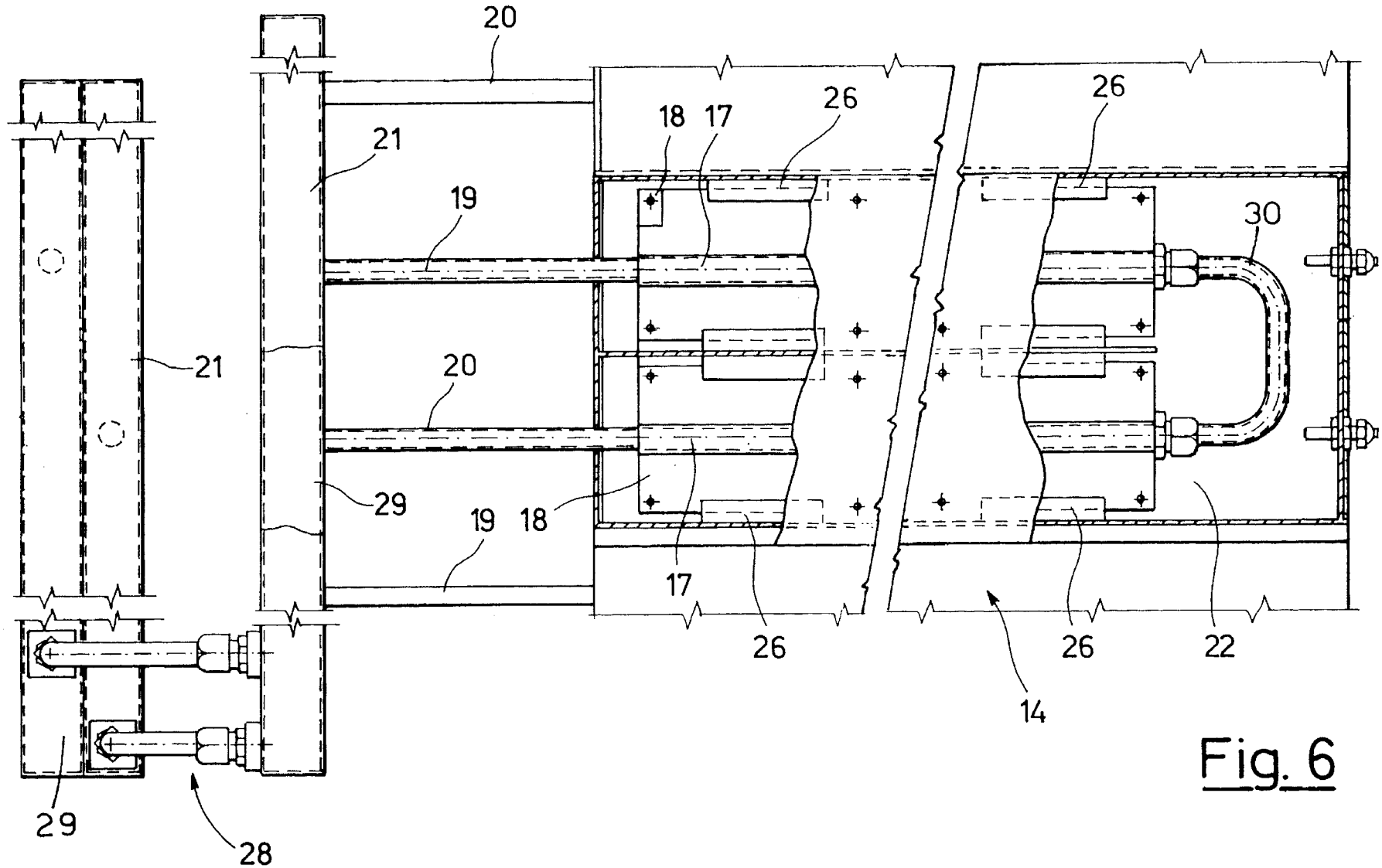
FIG. 6 is a diagrammatic side elevational view of a connection fluid circuit for the exchange elements of FIG. 4.

As shown in FIG. 6, present within each interspace 22 is a circuit 17 extending in the middle of the cavity to be parallel to the walls 23, 24 and being part of the brine fluid circulating system. Each circuit 17 has fins 18 parallel to the walls 23, 24 of the panel and is disposed in an intermediate plane between them, which fins have opposite ends slidably housed in supports 26.

As still viewed from FIGS. 4 and 6, panels 14 have inner parallel circuits 17 connected in pairs at one end thereof, at a passage between the respective interspaces 22, by means of a U-shaped coupling 30, at the other end the pipes of each pair issuing laterally from the panel by means of supply extensions or conduits 19, 20.

Advantageously, each panel can be formed with an extruded outer structure, even of one piece construction. Alternatively, panels can be formed of a plurality of modular elements each containing a U-shaped fluid passageway, to be fitted with each other so as to form a substantially continuous heat exchange surface exposed to the chamber 27.

Each U-shaped fluid passageway consisting of said pair of circuits 17 and the corresponding coupling 30, can freely expand parallelly of the circuit 17 axes, within its own interspaces, the fins 18 sliding in the supports 26. In this manner, the structure can absorb high thermal expansions, due to a $\Delta T$ of 60°/80° C.

Figure 5:
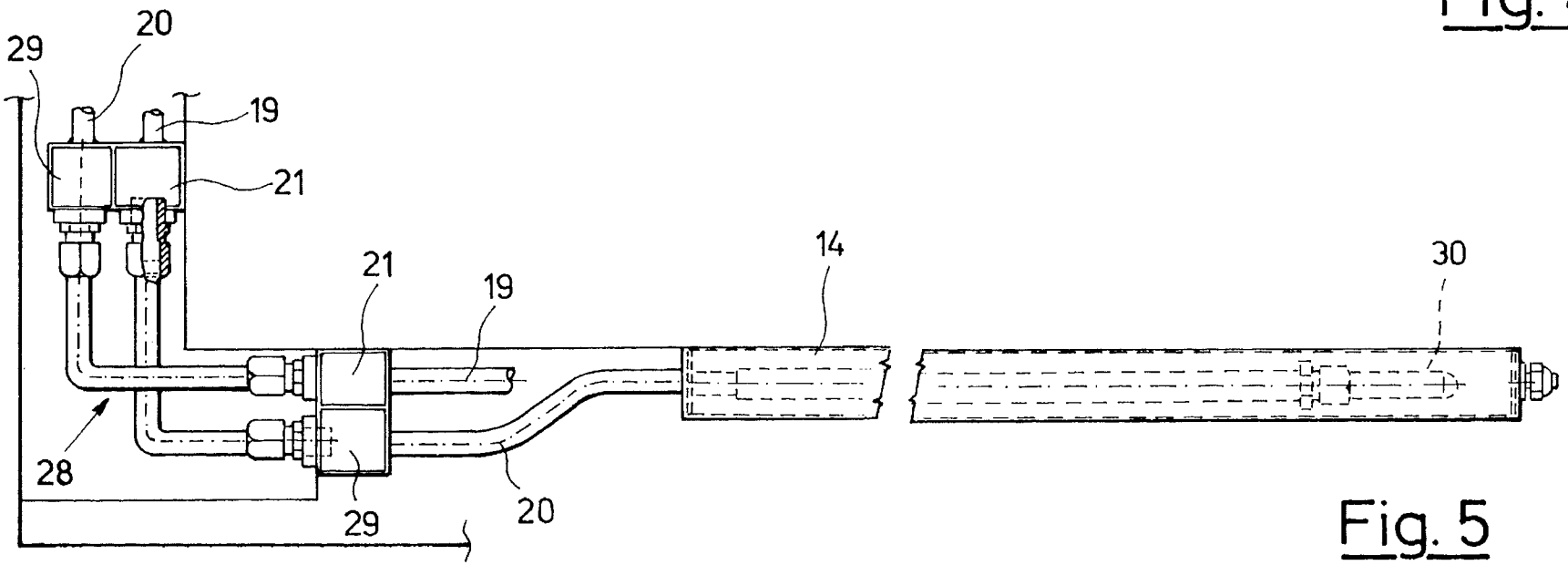
FIG. 5 is a fragmentary diagrammatic and part sectional view of a wall of the apparatus shown in FIG. 1 and containing the exchange elements of FIG. 4.

As shown in FIGS. 5 and 6, the U-shaped fluid passageways of a wall panel have the supply conduits 19, 20 connected to respective box-shaped headers or conduits 21 and 29, so that the U-shaped fluid passageways of the panel are connected to one another in parallel. In particular a corner area of the chamber 27 is shown in FIGS. 5 and 6 and the panels of the corner walls are connected therein to respective box-shaped conduits 21, 29 for entrance and exit of the refrigerant. The box-shaped inlet header (e.g. 21) of one wall is connected to the outlet header (e.g. 29) of the other wall through lower coupling ducts 28.

Advantageously, the box-shaped inlet and outlet headers 21, 29 of each panel are thermally connected to each other so as to reduce the temperature differences between the entrance and exit of the brine fluid to and from the panel as much as possible.

By virtue of the described structure, the brine fluid circulates within the exchangers so as to ensure a gradually and uniformly freezing of the liquid in the interspaces 22. The cooling action takes place between the brine fluid and the inner wall of the chamber exclusively through the thermal capacitance fluid, without thermal "short circuits".

As diagrammatically shown in FIG. 1, the chamber ceiling can advantageously comprise fins 32 to give a better heat exchange and utilization of the thermal capacitance of the ceiling.

By the innovatory structure described a substantial thermal continuity is achieved between all the chamber walls and in addition there is no substantial influence of the $\Delta T$ between the inlet temperature and outlet temperature of the brine circulating from the device 13. Thus a $\Delta T \leqq 2°$ C. can be achieved between the coldest and hottest points of the inner walls in the chamber even during the recharging step (refreezing of the liquid in the interspaces) while the products are inside the chamber. In addition, the $\Delta T$ between the exchange surfaces and the air in the chamber can be maintained to very low levels, typically $\leqq 2°$ C., which will enable a high relative humidity to be maintained within the chamber.

The substantial continuity of the wall interspaces containing the freezable thermal capacitance fluid together with the thermal insulating material 31 located outwardly of the chamber and the reduction of the thermal bridges between the inside and outside, form a thermal filter enabling an excellent insulation between the inner temperature of the chamber and the temperature at the outside of the container so that the former is not affected by variations of the latter. For example, it has been experimentally found that the attenuation of the apparent external sine curve is higher than 1:150. A test with an empty container and an apparent temperature ranging between +20° C. and +80° C. gives internal oscillations $\leqq$+/−0.5° C. within 24 hours, with a maximum gradient of 0.0416° C. in an hour. For comparison, traditional systems have oscillations $\geqq$+/−2.5° C. in an hour and therefore 240 times larger.

Freezing of the thermal capacitance fluid in the cavities 22 can be obtained when the products to be preserved have already been introduced into the chamber, as it takes place without thermal or RH stresses. In fact, freezing of the thermal capacitance fluid is substantially homogeneous over the whole extension of the interspaces, beginning from the pipe fins and extending towards the heat exchange walls 23, 24 without frozen bridges and preferential passages taking place, which would produce localized low-temperature areas on the walls. The optimal temperature is maintained by utilizing the phase change of the fluid in the interspaces.

When the products put into the chamber 27 have not been previously brought to a temperature close to the inner temperature of the chamber, the heat absorption and consequent cooling of the products takes place in a completely gradual and uniform manner without the temperature in the chamber undergoing important variations and therefore without the products undergoing thermal or RH stresses.

In order that the products may reach the preservation temperature present in the chamber in a quicker manner, a low-speed ventilation system 15 may also be provided, so that an excellent efficiency is achieved without undesired effects being produced. In fact, the high air humidity enables an optimized exchange and quick cooling of the products without the same being dehydrated, even using ventilation means 15 in which the air velocity is lower than 5 m/s and preferably in the order of 1 m/s, as compared to 10/15 m/s in the conventional systems. The ventilation means may be of the distributed type so as to create a uniform stream, embodied for example by tangential fans mounted to the chamber ceiling.

Thanks to the homogeneous solidification and melting of the liquid in the interspaces, the brine fluid is allowed to circulate even when the products are already under preservation conditions, in order to "restore" or "recharge" the thermal accumulators.

The system enables important storage capacities, exceeding one hundred thousand frigories. Thus it is possible to take up heat generated by vegetable products in an optimal manner.

It should be also noted that as the internal temperature stands very close to the minimum acceptable temperature for a good preservation of the products (maximum freezing point) and the relative humidity stands at high values, heat dissipated from fresh fruit and vegetables drastically decreases thereby enabling a larger autonomy. The apparatus of the invention performs its function of maintaining the products to the predetermined temperature even when the external temperature is lower than the temperature inside the container, if part of the fluid within the wall interspaces is maintained in the liquid state, carrying out a periodical fluid circulation at an appropriate temperature, if necessary.

Obviously the above description applying the innovatory principles of the invention is given for purposes of illustration only and therefore shall not be considered as a limitation of the scope of the invention as herein claimed.

For example, the device 13 for the circulation of the refrigerant and removal of heat therefrom can be made as an element separable from the container 11. In this manner, once freezing of the thermal capacitance fluid in the wall interspaces has been obtained, the device 13 can be disconnected, for example through the use of separable coupling elements 33 (embodying a so-called "plug in minicharger"), the temperature inside the container being held for long periods of time, due to the large thermal capacitance resulting from the important continuous volume of liquid frozen in the walls, and high thermal insulation coefficient.

Finally, in order to adapt the apparatus 10 to different temperatures within the chamber, valve means 40 (easily discernible by a person skilled in the art) can be provided for quickly replacing the liquid in the interspaces. For the purpose the interspaces form a circuit without retention pockets.

What is claimed is:

1. A method for absorbing heat and keeping perishable products under optimal preservation conditions at a predetermined temperature, including inserting the perishable products into a chamber of which at least 70% of the wall surfaces comprises hollow box-shaped panels the interspaces of which are filled with a thermal capacitance fluid having a freezing temperature in the range of between −1° C. and −4° C. compared to said predetermined temperature, and within the panel interspaces there being disposed brine fluid circuits, circulating through sad circuits in heat exchange relation with said thermal capacitance fluid a brine fluid at a temperature in the range of between −5° C. and −30° C. compared to the predetermined temperature, and maintaining the ΔT between the maximum and minimum temperature points of the wall surfaces under 5° C.

2. A method according to claim 1, including maintaining the thermal capacitance fluid in the wall interspaces in a state of simultaneous presence of solid and liquid phases.

3. A method according to claim 1, characterized in that when the fluid in the wall interspaces is at least partly in its fluid phase, brine fluid can be periodically recirculated in the circuits.

4. A method according to claim 1, including circulating air can in the chamber at a velocity lower than 5 m/s and preferably in the order of 1 m/s.

5. An apparatus for absorbing heat and keeping perishable products under optimal preservation conditions at a predetermined temperature, which comprises a housing having spaced walls defining in the housing a chamber into which the perishable products are disposed to be introduced, at least 70% of the wall surfaces of the chamber comprising box-shaped panels having therein interspaces filled with a thermal capacitance fluid having a freezing temperature in the range of between −1° C. and −4° C. compared to said predetermined temperature, and a plurality of brine fluid circuits containing a brine fluid fed at a temperature having a range of between −5° C. and −30° C. compared to the predetermined temperature, said circuits being provided within the panel interspaces in spaced relation to each other in order to effect and to distribute an exchange of heat between the brine fluid and the thermal capacitance fluid in the interspaces so that the T between the maximum and minimum temperature points of the wall surfaces will be kept under 5° C.

6. An apparatus according to claim 5, characterized in that the circuits in the interspaces comprise fins disposed parallel to said wall surfaces.

7. An apparatus according to claim 6, characterized in that the circuit fins have their ends slidably received in supports in the respective interspaces.

8. An apparatus according to claim 6, characterized in that the brine fluid circulating circuits are connected to means for refrigerating the fluid by means of separable coupling elements.

9. An apparatus according to claim 5, characterized in that the circuits of each wall extend intermediate their ends parallel to each other and are interconnected in pairs at one end thereof, and at the other ends thereof one circuit in each pair thereof being connected to an inlet brine fluid header and the other circuit in the pair being connected to an outlet brine fluid header.

10. An apparatus according to claim 9, characterized in that the inlet header and outlet header are thermally connected to each other.

11. An apparatus according to claim 9, characterized in that each pair of circuits is free to expand in the axial direction of the circuits themselves, within the respective interspaces.

12. An apparatus according to claim 5, characterized in that a means is provided for moving the air in the chamber at a velocity lower than 5 m/sec and preferably in the order of 1 m/s.

13. An apparatus according to claim 5, characterized in that means is provided for replacing the fluid in the interspaces.

14. An apparatus according to claim 9, characterized in that the box-shaped panels are made of modular elements interconnected with each other so as to achieve a substantial wall surfaces continuity, each modular element comprising at least one of said circuit pairs mounted inside thereof.

* * * * *

UNITED STATES PATENT AND TRADEMARK OFFICE

CERTIFICATE OF CORRECTION

PATENT NO. : 5,548,967

DATED : August 27, 1996

INVENTOR(S) : Alberto Ghiraldi

It is certified that error appears in the above-indentified patent and that said Letters Patent is hereby corrected as shown below:

On the title page of the patent, between paragraphs (22) and (51) insert the following paragraph:

--(30) Foreign Application Priority Data
Jan. 24, 1994 (IT) Italy---MI94A000097--.

Signed and Sealed this

Twelfth Day of November, 1996

*Attest:*

Bruce Lehman

BRUCE LEHMAN

*Attesting Officer*

*Commissioner of Patents and Trademarks*